US009151193B2

(12) United States Patent
Delaloye et al.

(10) Patent No.: US 9,151,193 B2
(45) Date of Patent: Oct. 6, 2015

(54) ELECTRIC MOTOR DRIVEN LUBRICATION PUMP STARTUP CONTROL SYSTEM AND METHOD

(75) Inventors: Jim Delaloye, Mesa, AZ (US); Matthew Christopher, Phoenix, AZ (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 705 days.

(21) Appl. No.: 12/181,195

(22) Filed: Jul. 28, 2008

(65) Prior Publication Data

US 2010/0018806 A1 Jan. 28, 2010

(51) Int. Cl.

| | |
|---|---|
| ***F01M 5/00*** | (2006.01) |
| ***F01M 5/02*** | (2006.01) |
| *F01M 1/02* | (2006.01) |

(52) U.S. Cl.

CPC ..... *F01M 5/025* (2013.01); *F01M 2001/0215* (2013.01)

(58) Field of Classification Search

USPC ..... 184/6.3; 123/196 R

See application file for complete search history.

(56) References Cited

U.S. PATENT DOCUMENTS

| | | | | |
|---|---|---|---|---|
| 4,967,882 | A | 11/1990 | Meuer et al. | |
| 5,184,456 | A | 2/1993 | Rumford et al. | |
| RE34,276 | E | 6/1993 | Glaser et al. | |
| 5,339,776 | A | 8/1994 | Regueiro | |
| 5,884,601 | A | 3/1999 | Robinson | |
| 6,269,788 | B1 | 8/2001 | Kachelek | |
| 6,604,494 | B2 | 8/2003 | Skrzypchak et al. | |
| 6,655,342 | B1 | 12/2003 | Wendels et al. | |
| 6,705,270 | B1 | 3/2004 | Rau et al. | |
| 6,904,879 | B2 | 6/2005 | Kato | |
| 6,945,207 | B2 | 9/2005 | Biess et al. | |
| 7,055,486 | B2 | 6/2006 | Hoff et al. | |
| 7,114,482 | B2 | 10/2006 | Lane | |
| 7,451,753 | B2 * | 11/2008 | Bell et al. | 123/601 |
| 2004/0187835 | A1 * | 9/2004 | Hoff et al. | 123/196 R |
| 2007/0234739 | A1 | 10/2007 | Delaloye et al. | |
| 2009/0000592 | A1 * | 1/2009 | Luft et al. | 123/196 R |
| 2010/0018805 | A1 * | 1/2010 | Sachdev et al. | 184/6.3 |

* cited by examiner

*Primary Examiner* — William E Dondero
*Assistant Examiner* — Robert T Reese
(74) *Attorney, Agent, or Firm* — Ingrassia Fisher & Lorenz, P.C.

(57) ABSTRACT

A system and method are provided for controlling an electric motor driven lubrication supply pump that is supplied with electrical power from a power bus, and that supplies lubricant to a rotating machine that is at least part of a vehicle subsystem. A determination is made that the subsystem is being started-up. Moreover, one or more lubricant parameters, power bus electrical state, and one or more lubricant load states are determined. The electrical power supplied from the power bus to the electric motor is varied, based on the one or more lubricant parameters, the power bus electrical state, and the one or more lubricant load states.

3 Claims, 2 Drawing Sheets

ELECTRIC MOTOR DRIVEN LUBRICATION PUMP STARTUP CONTROL SYSTEM AND METHOD

STATEMENT REGARDING FEDERALLY SPONSORED RESEARCH OR DEVELOPMENT

This invention was made with Government support under Contract No. N00019-02-C-3002, awarded by the U.S. Navy. The Government has certain rights in this invention.

TECHNICAL FIELD

The present invention relates to turbomachine lubrication and, more particularly, to a system and method for controlling lubricant delivery to one or more rotating machines during system startup.

BACKGROUND

Many aircraft gas turbine engines are supplied with lubricant from a pump driven lubrication supply system. In particular, the lubrication supply pump, which may be part of a pump assembly having a plurality of supply pumps on a common, engine-driven or electric motor driven shaft, draws lubricant from a lubricant reservoir, and increases the pressure of the lubricant. The lubricant is then delivered, via an appropriate piping circuit, to the engine. The lubricant is directed, via appropriate flow circuits within the engine, to the various components that may need lubrication, and is collected in one or more recovery sumps in the engine. One or more of the pump assembly pumps then draws the lubricant that collects in the recovery sumps and returns the lubricant back to the reservoir.

Gas turbine engines, including propulsion engines, auxiliary power units, and various other turbomachines, may need to be started up over a broad range of ambient conditions. Designing a gas turbine engine system, including its associated lubrication supply system, to start following prolonged cold-soaked conditions can be a challenge. During such a start, the system needs to supply adequate engine torque-speed-fuel-fire, as well as adequate lubricant flow to at least the more critical lubricant-wetted components of the engine. Typically, lubrication supply systems are optimally designed for at hot, steady state at maximum altitude, which leaves more than the needed performance during a cold-start. As a result, during a cold-start, as well as certain other system startup conditions, more power is consumed by the lubrication supply systems than may be needed to fully implement the system startup.

Hence, there is a need for a system and method of controlling power consumed by a lubrication supply system during lubricant system startup. The present invention addresses at least this need.

BRIEF SUMMARY

In one embodiment, and by way of example only, an aircraft lubrication supply system includes a motor, a pump, and a controller. The motor is adapted to receive electrical power from a power bus and is operable, upon receipt of the electrical power, to rotate and supply a drive torque. The pump is coupled to receive the drive torque from the motor and is configured, in response thereto, to supply lubricant to a lubricant load. The controller is adapted to couple to the power bus, and is further adapted to receive one or more signals representative of one or more lubrication supply system parameters, one or more signals representative of power bus electrical state, one or more signals representative of one or more lubricant load states, and a system startup signal indicating that at least the lubrication supply system is being started up. The controller is responsive to at least these signals to controllably vary the electrical power supplied from the power bus to the motor.

In another exemplary embodiment, an aircraft lubrication supply system includes a motor, a pump, and a controller. The motor is adapted to receive electrical power from a power bus and is operable, upon receipt of the electrical power, to rotate and supply a drive torque. The pump is coupled to receive the drive torque from the motor and is configured, in response thereto, to supply lubricant to a lubricant load. The controller is adapted to couple to the power bus, and is further adapted to receive one or more signals representative of one or more lubrication supply system parameters, one or more signals representative of power bus electrical state, one or more signals representative of one or more lubricant load states, and a system startup signal indicating that at least the lubrication supply system is being started up. The controller responsive to at least these signals to determine, in real-time, a minimal amount of electrical power that may be supplied from the power bus to the motor, and to implement startup control logic to control the electrical power supplied from the power bus to the motor to the minimal amount.

In yet another exemplary embodiment, a method of is provided for controlling an electric motor driven lubrication supply pump that is supplied with electrical power from a power bus, and that supplies lubricant to a rotating machine that is at least part of a vehicle subsystem. The method includes the steps of determining that the subsystem is being started-up, determining one or more lubricant parameters, determining power bus electrical state, and determining one or more lubricant load states. The electrical power supplied from the power bus to the electric motor is varied, based on the one or more lubricant parameters, the power bus electrical state, and the one or more lubricant load states.

Other independent features and advantages of the preferred lubrication supply system and method will become apparent from the following detailed description, taken in conjunction with the accompanying drawings which illustrate, by way of example, the principles of the invention.

DETAILED DESCRIPTION OF A PREFERRED EMBODIMENT

The following detailed description is merely exemplary in nature and is not intended to limit the invention or its application and uses. Furthermore, there is no intention to be bound by any theory presented in the preceding background or the following detailed description. In this regard, although the system is depicted and described as supplying lubricant to a turbomachine, it will be appreciated that the invention is not so limited, and that the system and method described herein may be used to supply lubricant to any one of numerous airframe (or other vehicle) mounted rotating machines.

Figure 1:
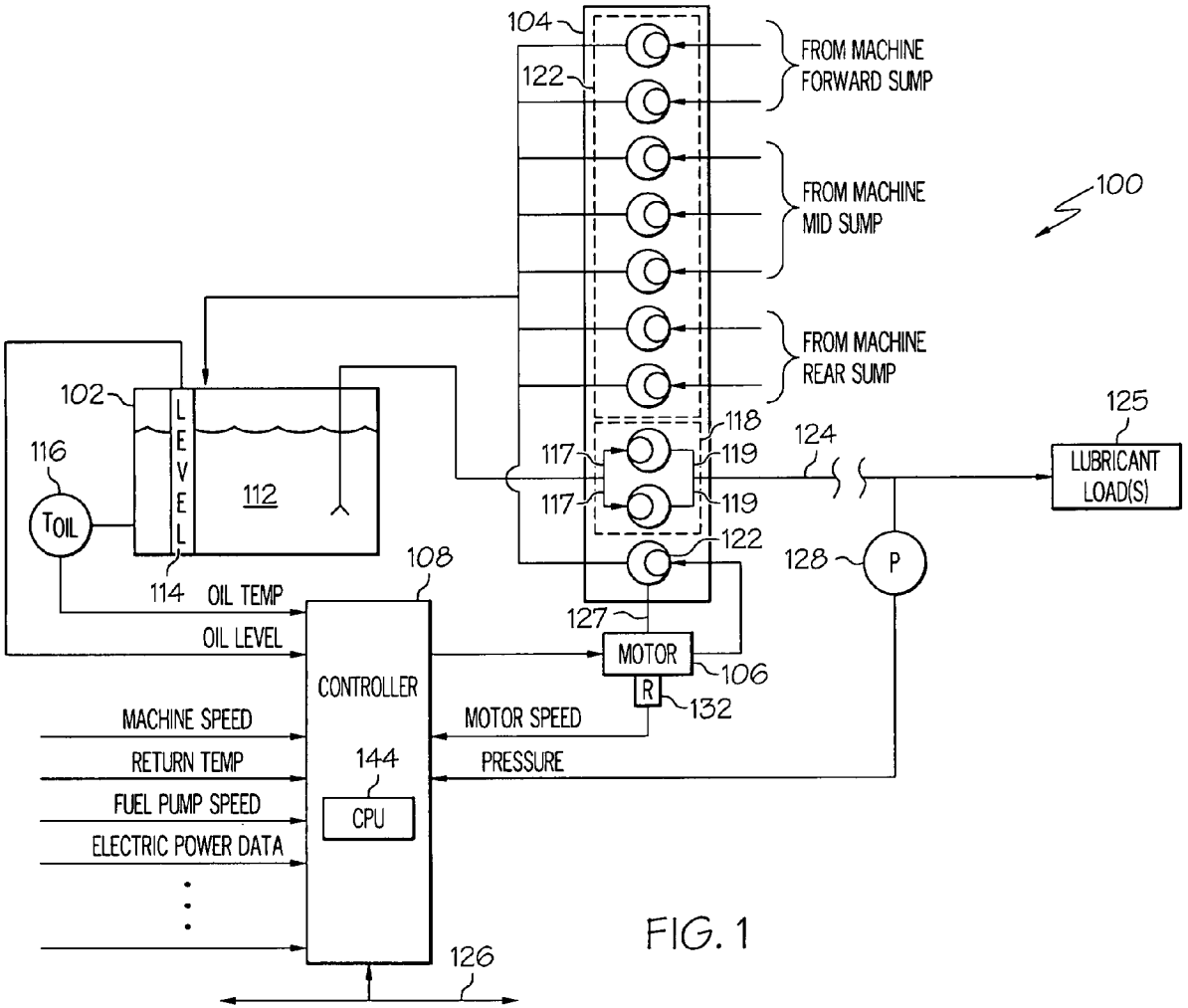
FIG. 1 is a schematic diagram of an aircraft lubrication supply system according to an exemplary embodiment of the present invention.

With reference now to FIG. 1, a schematic diagram of an exemplary aircraft lubrication supply system 100 is depicted, and includes a reservoir 102, a pump assembly 104, a motor 106, and a controller 108. The reservoir 102 is used to store a supply of lubricant 112 such as, for example, oil or other suitable hydraulic fluid. A level sensor 114 and a temperature sensor 116 may be installed within, or on, the reservoir 102. The level sensor 114, if included, senses the level of lubricant in the reservoir 102 and supplies a level signal representative of the sensed level to the controller 108. The temperature sensor 116, if included, senses the temperature of the lubricant in the reservoir 102 and supplies a temperature signal representative of the sensed temperature to the controller 108.

The pump assembly 104 is configured to draw lubricant from, and return used lubricant to, the reservoir 102. In the depicted embodiment the pump assembly 104 includes a plurality of supply pumps 118 and a plurality of return pumps 122. The supply pumps 118 each include a fluid inlet 117 and a fluid outlet 119. The supply pump fluid inlets 117 are each coupled to the reservoir 102, and the supply pump fluid outlets 119 are each coupled to a lubricant supply conduit 124. The supply pumps 118, when driven, draw lubricant 112 from the reservoir 102 into the fluid inlets 117 and discharge the lubricant, at an increased pressure, into the fluid supply conduit 124, via the fluid outlets 119. The lubricant supply conduit 124, among other potential functions, supplies the lubricant to one or more lubricant loads 125, such as one or more rotating machines. Although one or more various types of loads could be supplied with the lubricant, in the depicted embodiment the lubricant is supplied to a rotating turbomachine. It will be appreciated that each of the pumps 118, 122 that comprise the pump assembly 104 could be implemented as any one of numerous types of centrifugal or positive displacement type pumps, but in the preferred embodiment each pump 118, 122 is implemented as a positive displacement pump.

The lubricant that is supplied to the rotating turbomachine flows to various components within the turbomachine and is collected in one or more sumps in the turbomachine. The lubricant that is collected in the turbomachine sumps is then returned to the reservoir 102 for reuse. To do so, a plurality of the return pumps 122 draws used lubricant from the turbomachine sumps and discharges the used lubricant back into the reservoir 102 for reuse. Before proceeding further it will be appreciated that the configuration of the pump assembly 104 described herein is merely exemplary, and that the pump assembly 104 could be implemented using any one of numerous other configurations. For example, the pump assembly 104 could be implemented with a single supply pump 118 and a single return pump 122, or with just one or more supply pumps 118. No matter how many supply or return pumps 118, 122 are used to implement the pump assembly 104, it is seen that each pump 118, 122 is mounted on a common pump assembly shaft 127 and is driven via a drive force supplied from the motor 106.

The motor 106 is coupled to the pump assembly shaft 127 and is operable, upon being energized from a power bus 126, to supply a drive force to the pump assembly 104 that drives the pumps 118, 122. In the depicted embodiment the motor 106 is directly coupled to the pump assembly shaft 127. It will be appreciated, however, that the motor 106, if needed or desired, could be coupled to the pump assembly shaft 127 via one or more gear assemblies, which could be configured to either step up or step down the motor speed. It will additionally be appreciated that the motor 106 could be implemented as any one of numerous types of AC or DC motors, but in a particular preferred embodiment the motor 106 is implemented as a brushless DC motor.

The controller 108 is coupled to, and selectively energizes, the motor 106 from the power bus 126. Although the controller 108 is depicted using a single function block, it is noted that the controller 108 may be implemented as a single device or as two or more separate devices. For example, the controller 108 may implement the functions of both a motor controller and an engine (or other rotating machine) controller, or the controller 108 may be implemented separately, as a motor control unit and an engine control unit.

Regardless of its specific physical implementation, the controller 108 preferably implements control logic via, for example, one or more central processing units 144 (only one shown) that selectively energizes the motor 106 from the power bus 126 to thereby control the rotational speed of the motor 106. The control logic that the controller 108 implements preferably varies with the operational state of the system 100. For example, the control logic that the controller 108 implements during a startup sequence of the system 100 differs from the control logic that the controller 108 implements during post-startup operations of the system 100. More specifically, during post-startup operations the controller 108 implements what is referred to herein as operational control logic, which may include a closed-loop pressure control law, or a closed-loop speed control law. If the controller 108 implements a closed-loop pressure control law, the system 100 may include one or more pressure sensors 128 (only one depicted) to sense lubricant pressure and to supply a pressure feedback signal representative of the sensed pressure to the controller 108. Moreover, if the controller 108 implements a closed-loop speed control law, the system 100 may include one or more rotational speed sensors 132 (only one depicted) to sense motor rotational speed and to supply a rotational speed feedback signal representative of the sensed rotational speed to the controller 108.

Conversely, during the startup sequence of the system 100, the controller 108 implements what is referred to herein as startup control logic. When implementing the startup control logic, the controller 108 only selectively energizes the motor 106 from the power bus 126 to more efficiently utilize the electric power available on the power bus 126. More specifically, the controller 108, based on various lubrication load 125 (e.g., rotating machine), system, and/or vehicle parameters during the startup sequence, only selectively energizes the motor 106. In this manner, the electrical power that is available on the power bus 126 may be more efficiently utilized by other electrical loads during the startup sequence. Moreover, the overall electrical energy dissipated by the lubrication supply system 100 during the startup sequence may be reduced relative to a mechanically-driven system or to an electrical system that does not implement this functionality.

To implement the above-described functionality, and as FIG. 1 further depicts, the controller 108 also receives signals representative of various rotating machine 125, system 100, and/or vehicle parameters. The startup control logic in the controller 108, based at least in part on these signals, varies the electrical power supplied from the power bus 126 to the motor 106. It will be appreciated that the specific rotating machine 125, system 100, and/or vehicle parameters that are supplied to the controller, for use by at least the startup control logic, may vary. Preferably, signals representative of various lubrication supply system parameters, power bus electrical state, and lubrication load states (e.g., rotating machine states) are supplied to the controller 108. In the depicted embodiment, these include signals representative of lubricant supply temperature, lubricant return temperature, lubricant supply pressure, rotating machine rotational speed, fuel pump speed, data representative of electrical power needed by other loads (including loads associated with the rotating machine 125) on the power bus 126, the power being supplied by the power bus to other electrical loads, and temperatures of various rotating machine components that are supplied with lubrication (e.g., bearing temperatures), just to name a few.

Figure 2:
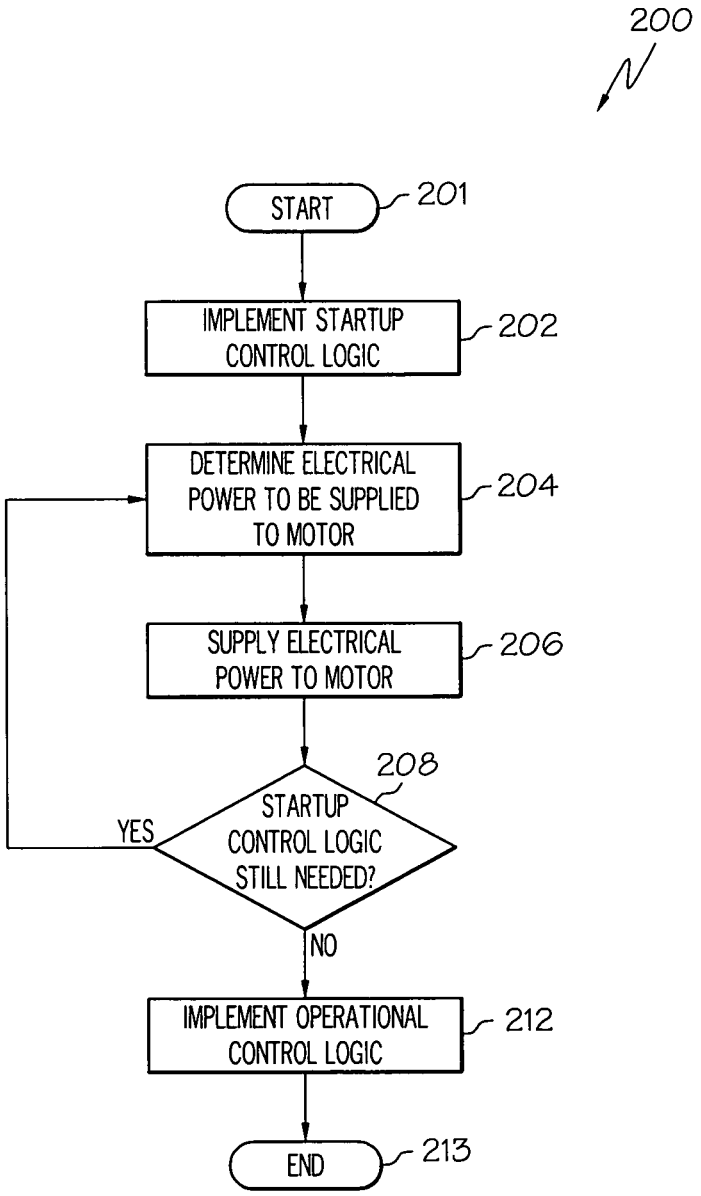
FIG. 2 is a flowchart depicting a methodology implemented in the system of FIG. 1 during a startup thereof.

Referring now to FIG. 2, it is seen that when the startup sequence for the system 100 (or the entire vehicle) is initiated, the controller 108 implements the startup control logic (202). Preferably, the controller 108 determines that the startup sequence is initiated based on a suitable signal, such as a system startup signal, indicating that at least the lubrication supply system 100 is being started up. It will be appreciated that the system startup signal may be supplied from an external source, be generated based on a manual input, or be generated internally based on various parameters when system components are energized. In any case, when the startup control logic is initiated, it determines, in real-time, the appropriate amount of electrical power that should be supplied from the power bus 126 to the motor 106 to ensure the rotating machine 125 (and various other loads, as appropriate) is adequately lubricated (204), and supplies the electrical power to the motor 106 (206). In some embodiments, the startup control logic may determine, in real-time, the minimal amount of electrical power that should be supplied from the power bus 126 to the motor 106, and control the electrical power supplied from the power bus 126 to the motor 106 to the minimal amount. This process 200 continues until the controller 108 determines that the startup control logic is no longer needed (208). Upon making this determination, the controller 108 implements the operational control logic.

As described herein, the controller 108, when implementing the startup control logic, controllably varies the electrical power supplied from the power bus 126 to the motor 106 to more efficiently utilize the electric power available on the power bus 126. As a result, the electrical power that is available on the power bus 126 may be more efficiently utilized by other electrical loads during a startup sequence, and the overall electrical energy dissipated by the lubrication supply system 100 during the startup sequence may be reduced relative to a mechanically-driven system or to an electrical system that does not implement this functionality.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An aircraft lubrication supply system, comprising:

a motor adapted to receive electrical power from a power bus and operable, upon receipt of the electrical power, to rotate and supply a drive torque;

a pump coupled to receive the drive torque from the motor and configured, in response thereto, to supply lubricant to a rotating machine; and a controller configured to couple to the power bus, the controller further adapted to receive signals representative of lubricant supply temperature, lubricant return temperature, lubricant supply pressure, pump speed, rotating machine rotational speed, electrical power needed by other electric loads on the power bus, electrical power being supplied from the power bus to other electrical loads, and a system startup signal indicating that at least the lubrication supply system is being started up, the controller responsive to at least these signals to:

(i) determine, in real-time, and based on at least these signals, a minimal amount of electrical power that may be supplied from the power bus to the motor, and (ii) implement startup control logic to to only selectively energize the motor from the power bus to the minimal amount.

2. The system of claim 1, wherein the controller is further operable to determine when the startup control logic should no longer be implemented and, upon making this determination, implements operational control logic.

3. The system of claim 1, further comprising:

a fuel pump in fluid communication with, and operable to supply fuel to, the rotating machine, wherein the controller additionally receives a signal representative of fuel pump speed.

* * * * *